US005564308A

United States Patent [19]

Hoshikawa et al.

[11] Patent Number: 5,564,308

[45] Date of Patent: Oct. 15, 1996

[54] ACTUATOR UNIT FOR VEHICLE DOOR LOCKING DEVICE

[75] Inventors: Tsuguo Hoshikawa; Fumihiro Yoneyama, both of Yamanashi-ken, Japan

[73] Assignee: Mitsui Kinzoku Kogyo Kabushiki Kaisha, Tokyo, Japan

[21] Appl. No.: 395,102

[22] Filed: Feb. 27, 1995

[30] Foreign Application Priority Data

Feb. 26, 1994 [JP] Japan ..... 6-053138

[51] Int. Cl.[6] ..... E05B 47/00; E05B 65/12

[52] U.S. Cl. ..... 74/89.14; 74/425; 74/606 R; 292/201; 292/336.3

[58] Field of Search ..... 74/89.14, 425, 74/606 R; 70/264, 277; 292/201, 336.3

[56] References Cited

U.S. PATENT DOCUMENTS

| | | | |
|---|---|---|---|
| 4,518,182 | 5/1985 | Cousin et al. | 292/201 |
| 4,706,512 | 11/1987 | McKernon et al. | 292/336.3 X |
| 5,062,312 | 11/1991 | Watanuki et al. | 74/89.14 |
| 5,106,133 | 4/1992 | Fukumoto et al. | 292/201 |
| 5,233,879 | 8/1993 | Watanuki et al. | 74/425 |
| 5,240,296 | 8/1993 | Kobayashi | 292/201 |
| 5,261,711 | 11/1993 | Mizuki et al. | 292/201 |
| 5,338,076 | 8/1994 | Tanaka | 292/336.3 |
| 5,394,039 | 2/1995 | Suchdev et al. | 310/51 |
| 5,409,277 | 4/1995 | Rogers, Jr. et al. | 292/336.3 |

FOREIGN PATENT DOCUMENTS

| | | | |
|---|---|---|---|
| 0267423A2 | 5/1988 | European Pat. Off. . | |
| 2200982 | 8/1990 | Japan | 292/201 |
| 2227049 | 7/1990 | United Kingdom . | |
| 2262769 | 6/1993 | United Kingdom . | |
| 88/01334 | 2/1988 | WIPO . | |

*Primary Examiner*—Charles A. Marmor
*Assistant Examiner*—Troy Grabow
*Attorney, Agent, or Firm*—Browdy and Neimark

[57] ABSTRACT

An actuator unit for a vehicle door locking device comprises a reversible motor, a gear shaft set to an output shaft of the motor, a rotational output member which rotates by engaging with the gear shaft, a driven lever which is changed in at least two positions in accordance with the rotation of the output member, and a housing for storing the above components. The housing is constituted with a main case and a sub case. A first recess for storing the rotational output member, a second recess for storing the motor, a third recess for storing the gear shaft and support means for supporting a rotating shaft of the driven lever are formed on the main case. The output member fitted in the first recess and the gear shaft fitted in the third recess are constituted so that they maintain a meshing state mutually, and each component in the main case is secured at its home position by putting the sub case on the main case.

11 Claims, 4 Drawing Sheets

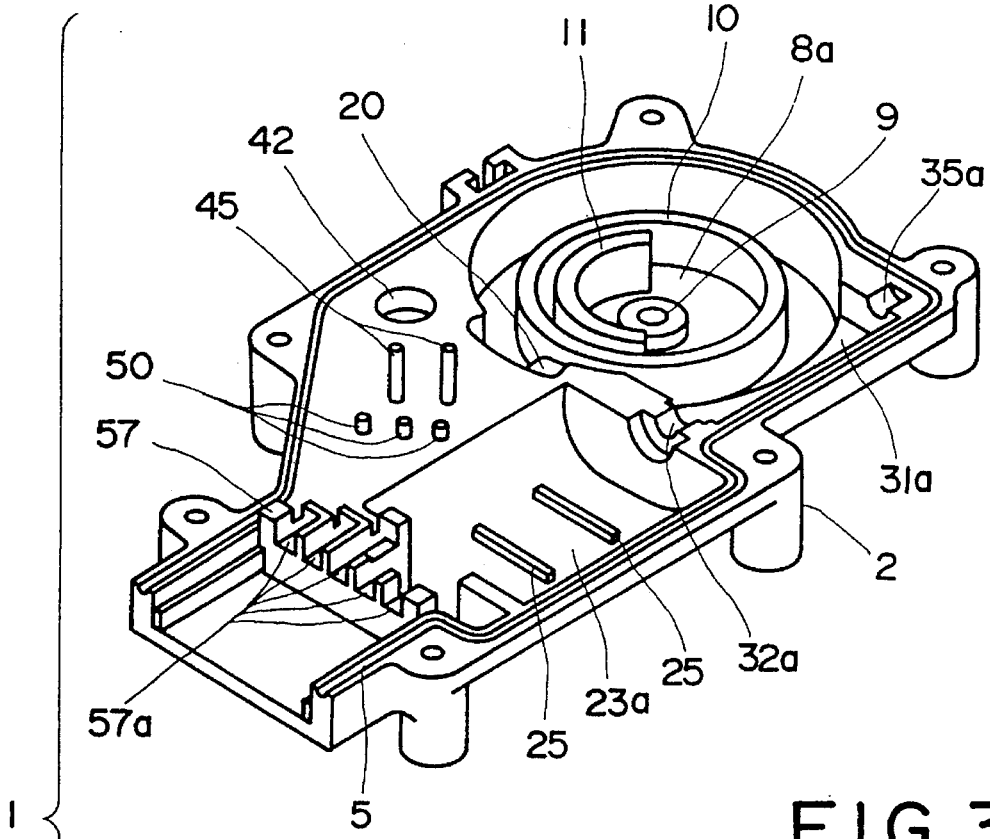
FIG. 3
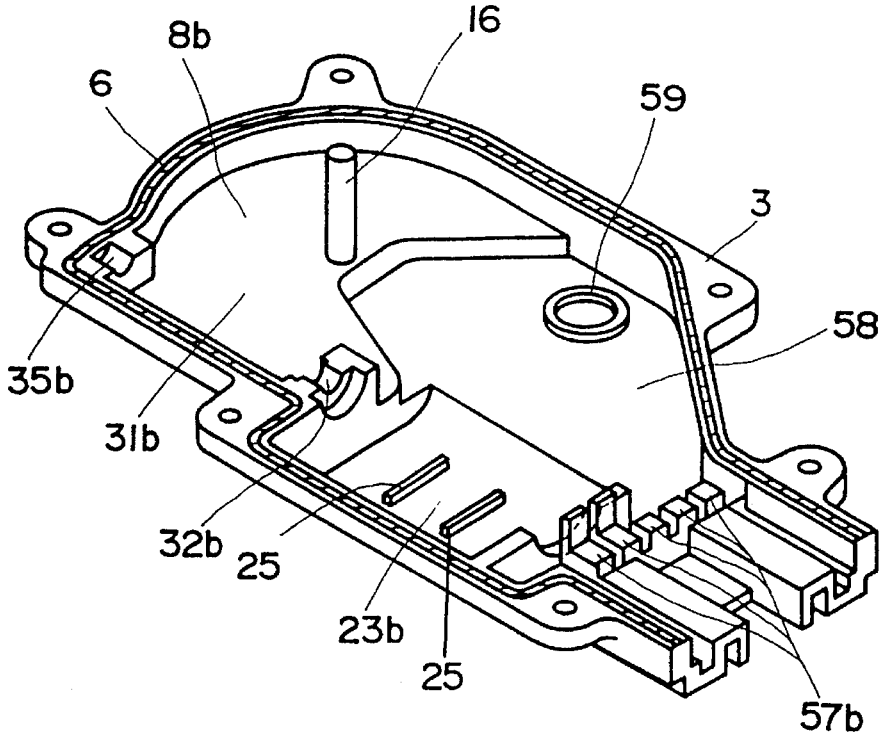

ACTUATOR UNIT FOR VEHICLE DOOR LOCKING DEVICE

FIELD OF THE INVENTION

The present invention relates to an actuator unit for a vehicle door locking device.

PRIOR ART

In a conventional vehicle door locking device, locked and unlocked conditions of the device are changed by shifting a locking lever thereof. The change by the locking lever can be performed by not only the operation of a door key or an inside door locking button but also the force of a motor.

Though the motor is directly set to the body of the locking device in some cases, it is independently assembled as a locking device in the other cases. In the case of this type of the independent unit, a motor is set in a housing practically closed together with a reducer, various switches and so on.

Japanese Patent Application Laid-Open No. 63-93979 discloses an actuator unit comprising a reversible motor, a gear shaft set to an output shaft of the motor, a rotational output member which rotates by engaging with the gear shaft, a driven lever to be changed in two positions in accordance with the rotation of the output member, and a housing including main and sub cases for storing these components.

The above prior art unit is assembled by setting each component to the main case and then putting the sub case on the main case, and thereafter securing the both cases. However, it takes a lot of time to assemble the unit because some of the components are secured to the main case by using screws, brackets and so on. Moreover, the unit also has some components which are merely put in the main case. Therefore, a problem also occurs that these components are moved from their correct positions when a slight vibration is applied to the main case because they are unstable.

OBJECT OF THE INVENTION

It is an object of the present invention to provide an actuator unit solving the above problems of the prior art unit. Therefore, in the case of the present invention, recesses and pin sections into which components are fitted are previously unified into one body so that the components can be mounted on the main case without using screws or the like.

Other features, objects and advantages of the present invention will become apparent from the following description of a preferred embodiment with reference to the drawings in which like reference characters designate like or corresponding parts throughout several views.

BRIEF DESCRIPTION OF THE DRAWINGS

FIG. 3 is perspective views of a main case and a sub case;

EMBODIMENTS

Figure 4:
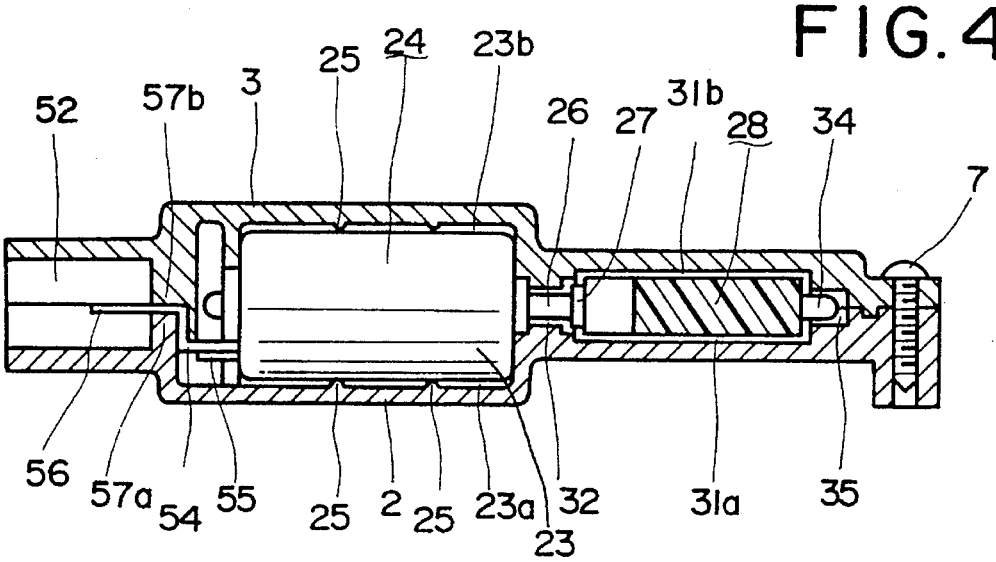
FIG. 4 is a sectional view showing the state in which a motor and a gear shaft are set.

A housing 1 of the actuator unit of the present invention is made of synthetic resin and comprises a main case 2 and a sub case 3 as shown in FIG. 3. A groove 5 in which a packing seal 4 (FIG. 1) can be set is formed at the edge of the main case 2 and a protrusion 6 which is forcibly fitted against seal 4 is formed at the edge of the sub case 3. The main case 2 and the sub case 3 are secured by securing means such as a screw 7 (FIG. 4).

Figure 1:
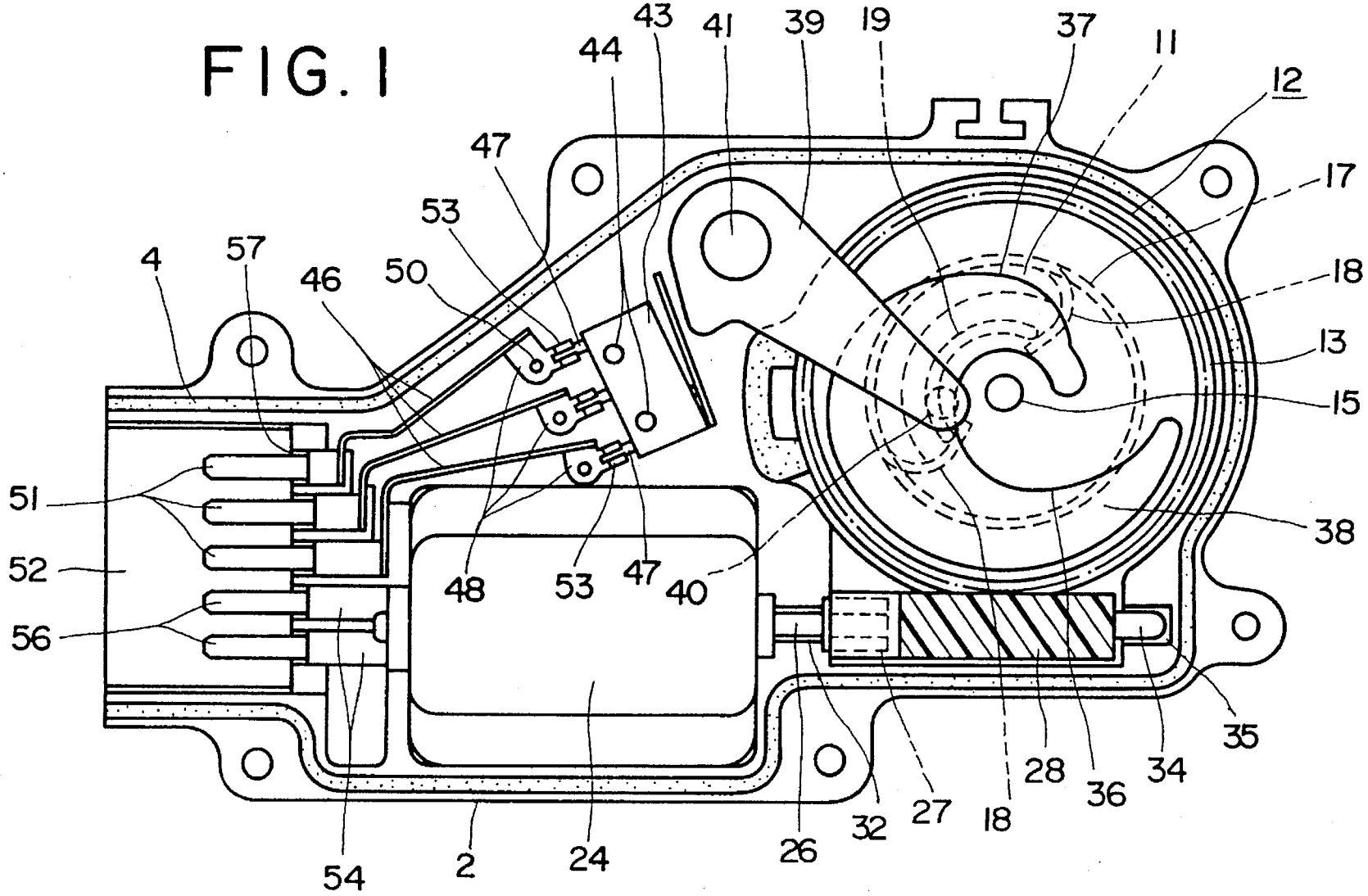
FIG. 1 is a top view of a main case to which various components are set.

The housing 1 has an approximately-cylindrical first space 8 formed by a recess **8*a* of the main case 2 and a recess 8*b* of the sub case 3. At the bottom of the recess 8*a* of the main case 2, a short cylindrical boss section 9, an annular support wall 10 centering around the boss section 9 and a semi-circular-arc mounting wall 11 located between the support wall 10 and the boss section 9 are formed as one body. A return spring 17 for holding a rotational output member 12 to be described later at a neutral position is set to the mounting wall 11 as shown in FIG. 1. The return spring 17 set to the mounting wall 11 is stably held because both ends 18 of the spring 17 are engaged with the both sides of the mounting wall 11** respectively.

Figure 5:
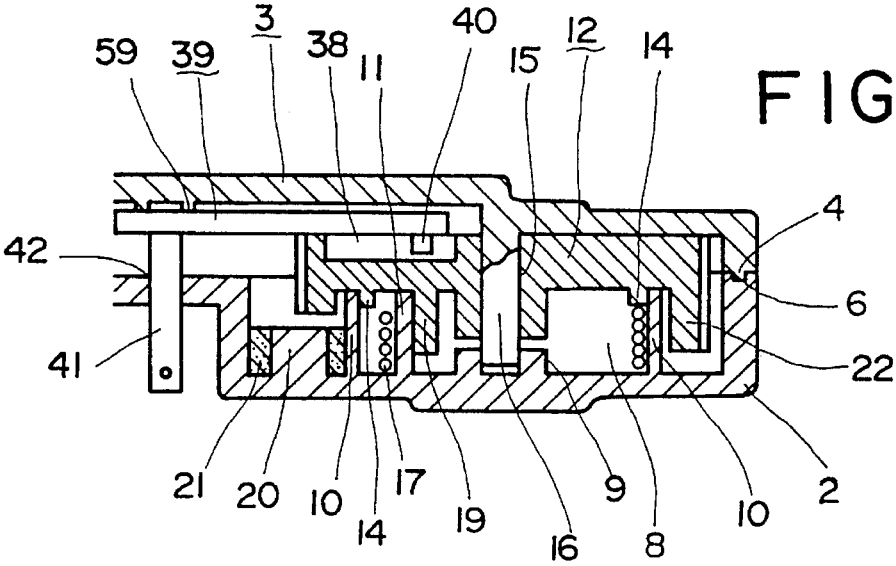
FIG. 5 is a sectional view showing the state in which a rotational output member is set.

The output member 12 stored in the first space 8 has a discoid shape with a gear section 13 formed on its outer periphery. As shown in FIG. 5, an axis hole 15 corresponding to the boss section 9 is formed at the central portion of the output member 12. An annular protrusion 14 with a diameter slightly smaller than the support wall 10 is integrally formed at the back side of the output member 12. Moreover, a semi-circular-arc engaging portion 19 is also integrally formed at the back side of the rotational output member 12. When the output member 12 is placed in the recess **8*a* of the main case 2 by inserting the engaging portion 19 between legs 18 of the return spring 17, the protrusion 14 enters the inside of the support wall 10 and thereby the output member 12** is held at a predetermined position.

A supporting shaft 16 is integrally formed at the bottom center of the recess **8*b* of the sub case 3 as shown in FIGS. 3 and 5. When the sub case 3 is engaged to the main case 2, the tip end of the supporting shaft 16 passes through the axis hole 15 of the output member 12 and is inserted into the boss section 9 of the main case 2. Therefore, the rotational output member 12 can easily be set in the first space 8 with no backlash when securing the sub case 3 to the main case 2**.

When the output member 12 is rotated by the force of a reversible motor 24 to be described later, the engaging portion 19 of the output member 12 engages with either leg 18 to compress the return spring 17. When the motor 24 is turned off, the output member 12 is returned to the neutral position by the force of the return spring 17.

Figure 2:
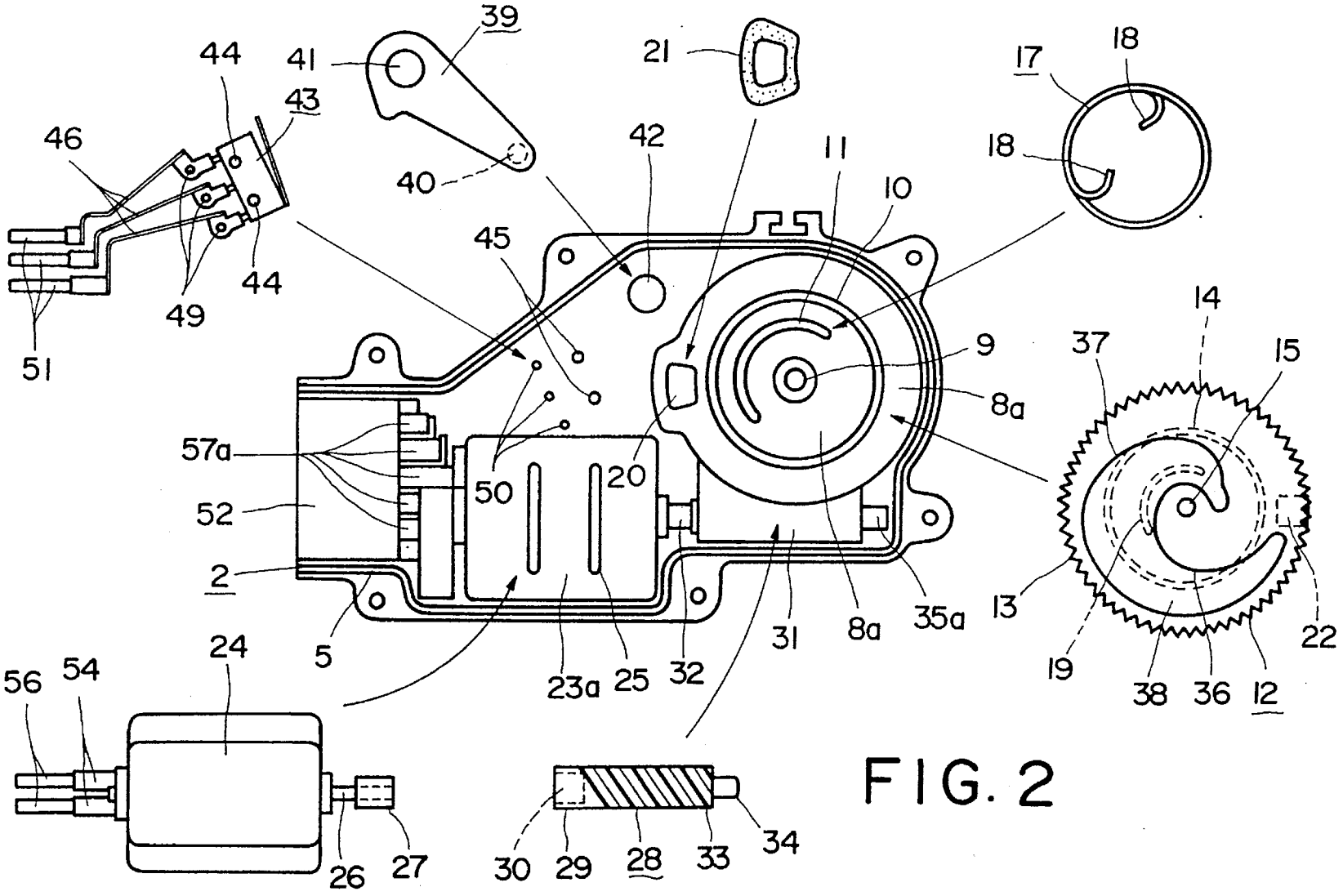
FIG. 2 is exploded views of a main case and components.

As shown in FIGS. 2 and 5, a short protrusion 20 is formed at one side of the recess **8*a* and a rubber stopper 21 is fitted to the protrusion 20. A protrusion 22 which contacts the rubber stopper 21 when the output member 12 rotates by approximately 180 degrees from the neutral position is formed at one side of the back side of the output member 12**.

The housing 1 has a second space 23 for storing the motor 24 formed by a recess **23*a* of the main case 2 and a recess 23*b* of the sub case 3. A pair of ribs 25 is formed at the bottom of the recesses 23*a* and 23*b* respectively. By securing the sub case 3 to the main case 2, the motor 24 is constituted so that it is held by the ribs 25. A deformed head 27 which is preferably hexagonal is secured to a output shaft 26 of the motor 24. A hexagonal socket 30 into which the head 27 is inserted is formed at a first end 29 of a gear shaft 28 like a cylindrical worm gear. The gear shaft 28 shown in FIG. 2 is made of synthetic resin. A supporting portion 34 with a small-diameter is integrally formed on a second end 33 of the shaft 28**.

The gear shaft 28 is stored in a third space 31 formed by the recess 31*a* of the main case 2 and the recess 31*b* of the sub case 3. A small recess 32*a* is formed between the recesses 31*a* and 23*a* of the main case 2 and further a small recess 32*b* is formed between the recesses 31*b* and 23*b* of the sub case 3. A path 32 through which the output shaft 26 of the motor 24 passes is formed by these recesses 32*a* and 32*b*. The small-diameter portion 34 is rotatably supported by a bearing section 35 comprising a recess 35*a* of the main case 2 and a recess 35*b* of the sub case 3. When the gear shaft 28 is set in the recess 31*a*, it engages with the gear section 13 of the output member 12 previously set in the recess 8.

The hexagonal head 27 and the hexagonal socket 30 are engaged each other so that they can slide in the axial direction. The gear shaft 28 is constituted by making the length of the shaft 28 shorter than that of the third space 31 so that the shaft 28 can slightly slide in its axial direction. Thus, the gear shaft 28 is smoothly meshed with the gear section 13 of the output member 12 when storing the shaft 28 in the third space 31 and moreover, the output member 12 is smoothly returned to the neutral position by the force of the return spring 17. That is, it is possible to prevent the gears from firmly engaging each other and causing a mechanically locked state.

Figure 6:
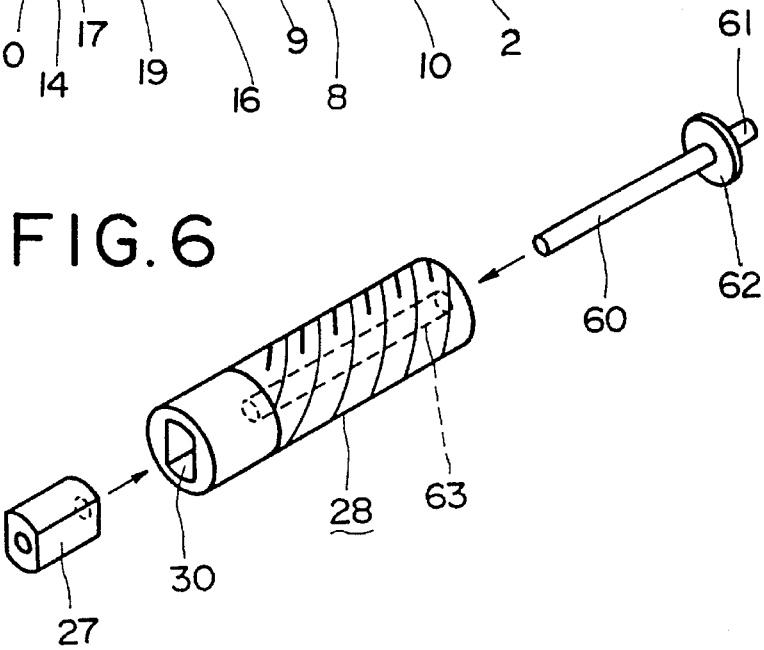
FIG. 6 is an illustration of a second embodiment of a gear shaft.

The gear shaft 28 shown in FIG. 6 has a through-hole 63 passing through the shaft 28 in the axial direction at the central portion. A reinforcing rod 60 is inserted into the hole 63 in order to improve the strength of the shaft 28. A flange 62 contacting with the gear shaft 28 is formed at one end of the rod 60 and a small-diameter portion 61 supported by the bearing section 35 is formed on the outer surface of the flange 62. The other end of the rod 60 is inserted into the head 27.

A cam groove 38 having a locking cam edge 36 and an unlocking cam edge 37 is formed on the upper surface of the output member 12 as shown in FIG. 1 and a pin 40 formed at the front end of the driven lever 39 is set in the cam groove 38. Shaft 41 protrudes on both sides of lever 39 and is integrally formed at the base end of the lever 39. The shaft 41 at the back side is protruded outward through a through-hole 42 formed on the main case 2 (see FIG. 5), and a well-known locking lever (not illustrated) for changing the locked and unlocked conditions of the locking device (not illustrated) is connected to the protrusion. The shaft 41 at the surface is supported by a boss section 59 of the auxiliary case 3. When the output member 12 rotates, the driven lever 39 rotates about the shaft 41 because the locking cam edge 36 or the unlocking cam edge 37 of the cam groove 38 contacts the pin 40 and thereby the position of the locking lever is changed to a locking position or unlocking position.

A switch 43 for detecting the position of the locking lever is arranged at the near side of the driven lever 39. A pair of pin holes 44 parallel with the shaft 41 are provided on the body of the switch 43 and a pair of pin shafts 45 to be inserted into the pin holes 44 are integrally formed on the main case 2. Three short pin shafts 50 are integrally formed at a position close to the pin shafts 45 of the main case 2. A pin hole 49 at each of a first end 48 of conductive connecting plates 46 is engaged with each pin shaft 50, respectively. A female contact 53 engaged with each of the three terminals 47 of the switch 43 is set to each first end 48 of the connecting plates 46. By setting the connecting plates 46 to the main case 2 by using the pin shafts 50 and the pin hole 49 and thereafter setting the switch 43 to the main case 2 by using the pin hole 44 and pin shaft 45, the terminals 47 of the switch 43 are automatically engaged with the female contacts 53 of the connecting plates 46.

A socket section 52 is formed at the left end of the housing 1 and a support section 57 comprising a plurality of groove sections 57*a* of the main case 2 and a plurality of protrusions 57*b* of the sub case 3 is formed at the root of the socket section 52. The connecting plates 46 for the switch 43 are respectively fitted into each groove section 57*a* of the main case 2 and accurately positioned so that second ends 51 of the connecting plates 46 protrude into the socket section 52. Similarly, connecting plates 54 engaged to terminals 55 of the motor 24 are fitted into a plurality of groove sections 57*a* so that ends 56 of the plates 54 protrude into the socket section 52.

When the sub case 3 is secured to the main case 2, the connecting plates 46 and 54 placed in each groove section 57*a* are held by each protrusion 57*b* of the sub case 3 and thereby their positions are prevented from being deviated. Symbol 58 represents a recess formed on the sub case 3 to store the driven lever 39 and the switch 43.

OPERATION

The actuator unit of the present invention can be assembled without using tools except a screw driver for fastening the screw 7.

First, as shown in FIG. 2, an annular rubber stopper 21 is fitted into a protrusion 20 and legs 18 of the return spring 17 are engaged with the mounting wall 11. Then, the output member 12 is supported in the recess 8*a* by inserting the engaging portion 19 of the output member 12 between the legs 18 of the return spring 17. Thus, the annular protrusion 14 of the output member 12 is brought into the inside of the support wall 10 and thereby the output member 12 is held at a predetermined position.

Then, the hexagonal socket 30 of the gear shaft 28 is engaged with the hexagonal head 27 secured to the output shaft 26 of the motor 24 and each end of the connecting plates 54 is engaged with each terminal 55 of the motor 24. Thereafter, the motor 24 is supported in the recess 23*a*, the gear shaft 28 is supported in the recess 31*a*, and the connecting plates 54 are supported in the grooves 57*a*, respectively. Thus, they are fitted so that they are not deviated from each other due to a slight vibration. In this case, because the gear shaft 28 is slidable on the output shaft 26 and the recess 31*a* is slightly longer than the gear shaft 28, the gear shaft 28 easily meshes with the gear section 13 of the output member 12.

Then, three connecting plates 46 are set to the main case 2 by setting each pin hole 49 at one side to each pin shaft 50 and by fitting the other side to the groove section 57*a*. Thereafter the pin hole 44 of the switch 43 is inserted onto the pin shaft 45. Thus, the terminal 47 of the switch 43 is fitted to the female contact 53 of the connecting plate 46 and thereby setting of the switch 43 and connection between the terminal 47 and the connecting plate 46 can simultaneously be made.

Then, the shaft 41 of the driven lever 39 is passed through the through-hole 42 of the main case 2 so that the pin 40 at the tip end of the driven lever 39 is located in the cam groove 38 of the output member 12, the sub case 3 is put on the main case 2 while adjusting the supporting shaft 16 of the sub case 3 to the axis hole 15 of the output member 12, and the both cases are secured by the screw 7. Thus, assembling of the unit is completed with the components therein in operating position.

Therefore, the unit of the present invention can very easily be assembled because internal components are only supported in the recesses previously formed on the main case 2 or inserted onto pin shafts. Moreover, because each component is not removed or deviated even if a slight vibration is added to the main case 2 while the unit is assembled, smooth operations are expected.

In the case of the assembled unit, when the output member 12 is rotated by the motor 24 through the gear shaft 28, the pin 40 of the driven lever 39 contacts the locking cam edge 36 or the unlocking cam edge 37 and thereby the driven lever 39 rotates about the shaft 41. By connecting the shaft 41 of the unit to a locking lever (not illustrated) of a well-known door locking device, the locking lever positions can be changed by the force of the motor 24. Moreover, because the power of the motor 24 is reduced not only by the engagement between the gear shaft 28 and the gear section 13 of the output member 12 but also by the action of the locking cam edge 36 or the unlocking cam edge 37, the torque of the driven lever 39 becomes large enough.

In the above description, the supporting shaft 16 serving as the central shaft of the output member 12 is formed on the sub case 3 and the boss section 9 into which the tip end of the supporting shaft 16 is inserted is formed on the main case 2. However, on the contrary, it is also possible to form the supporting shaft 16 on the main case 2 and the boss section 9 on the sub case 3. Moreover, it is included in the idea of the present invention to form the supporting shaft 16 separately from a case or integrally form the support shaft 16 on the output member 12.

What is claimed is:

1. An actuator unit for a vehicle door locking device, comprising a reversible motor, a gear shaft engaged to an output shaft of the motor, a rotational output member which rotates by engaging with the gear shaft, a driven lever which is changed in at least two positions in accordance with the rotation of the output member, and a housing for storing the motor, gear shaft output member and the driven lever; wherein the housing comprises a main case and a sub case, a first recess storing the rotational output member, a second recess storing the motor, a third recess storing the gear shaft and a fourth recess storing the driven lever, first support means on said main case and said sub case for supporting said rotational output member in an operating position in said first recess, second support means on said main case and said sub case for supporting said motor in an operating position in said second recess;

third support means on said main case and said sub case for supporting said gear shaft in an operating position in said third recess and fourth support means on said main case and said sub case for supporting a rotating shaft of the driven lever in said fourth recess, the output member engaged in the first recess and the gear shaft engaged in the third recess to maintain a mutual meshing state, wherein the rotational output member, the motor, the gear shaft, and the driven lever are all supported on the main case and secured in a fixed operating position by engaging the sub case on the main case, wherein the first, second, third and fourth support means on the main case and sub case are engaged against the rotational output member, the motor, the gear shaft, and the driven lever.

2. The actuator unit according to claim 1, wherein the first support means comprises an annular support wall for supporting the rotational output member and a second boss section formed in the first recess of the main case, and a supporting shaft integrally formed on the sub case inserted into the second boss section and passing through the rotational output member.

3. The actuator unit according to claim 1, wherein the first support means comprises a supporting shaft extending through the central portion of the rotational output member into a second boss section which supports a tip end of the supporting shaft, said second boss section and said supporting shaft each respectively formed on the main and sub cases.

4. The actuator unit according to claim 1, wherein the second support means comprises at least two ribs contacting the motor formed respectively on the main case and the sub case.

5. The actuator unit according to claim 1, wherein the fourth support means comprises a through-hole on the main case through which the rotating shaft of the driven lever protrudes outward from the main case and a first boss section on the sub case.

6. The actuator unit according to claim 1, wherein the gear shaft has a cylindrical worm gear, the rotational output member has a discoid worm wheel on whose outer periphery a gear section meshing with the gear shaft is formed, the rotational output member having a cam groove which has a locking cam edge and an unlocking cam edge, and a pin formed on the driven lever engaged in the cam groove.

7. The actuator unit according to claim 1, wherein the gear shaft has a cylindrical worm gear having a small-diameter shaft portion integrally formed at a first end, and a second end of the gear shaft slidably engaged with the output shaft of the motor in the axial direction of the output shaft.

8. The actuator unit according to claim 1, wherein the gear shaft has an axial-directional through-hole, and a first end of a reinforcing rod with a small-diameter shaft portion passing through the through-hole.

9. The actuator unit according to claim 1, wherein the unit has a switch in the fourth recess for detecting the position of the driven lever and first pin shafts to support the switch are formed at a position close to the fourth support means.

10. The actuator unit according to claim 9 wherein the unit has a plurality of connecting plates each having a first end respectively connected to a plurality of terminals of the switch, and fifth support means comprising a plurality of groove sections formed on the main case to which a second end of each of the connecting plates are fitted and a protrusion corresponding to each groove section of said groove sections formed on the sub case, wherein when the sub case is engaged on the main case, the fifth support means engages against the second end of each of the connecting plates.

11. The actuator unit according to claim 9, wherein the unit has a plurality of connecting plates each having a first end connected to a plurality of terminals of the switch, a plurality of second pin shafts formed on the main case respectively inserted into pin holes provided at the first end of each of the connecting plates, and female contacts on the first end of the connecting plates into which the terminals of the switch are automatically inserted by engaging the switch to the main case.

* * * * *